United States Patent [19]

Loose

[11] Patent Number: 4,705,340

[45] Date of Patent: Nov. 10, 1987

[54] INSULATION DISPLACING BARREL TERMINAL

[75] Inventor: Winfield W. Loose, Harrisburg, Pa.

[73] Assignee: AMP Incorporated, Harrisburg, Pa.

[21] Appl. No.: 922,836

[22] Filed: Oct. 22, 1986

Related U.S. Application Data

[63] Continuation-in-part of Ser. No. 810,794, Dec. 19, 1985, abandoned, which is a continuation-in-part of Ser. No. 672,554, Nov. 19, 1984, abandoned.

[51] Int. Cl.[4] ..... H01R 4/24

[52] U.S. Cl. ..... 439/395

[58] Field of Search ..... 339/97 R, 97 P, 98, 339/99 R

[56] References Cited

U.S. PATENT DOCUMENTS

| | | | |
|---|---|---|---|
| 3,972,578 | 8/1976 | Reynolds et al. . | |
| 4,220,390 | 9/1980 | Cobaugh et al. . | |
| 4,283,105 | 8/1981 | Ferrell et al. | 339/97 R |
| 4,431,247 | 2/1984 | Abdullah et al. | 339/97 P |
| 4,575,173 | 3/1986 | Chapin et al. | 339/97 R |

*Primary Examiner*—Joseph H. McGlynn

*Attorney, Agent, or Firm*—Eric J. Groen

[57] ABSTRACT

A barrel-shaped terminal has two spiralled walls forming a cylinder of double thickness material. The terminal has two wire receiving openings, each in communication with a wire-receiving slot around the circumference of the cylinder. A cap fits over the terminal and has a central opening aligned with both wire-receiving openings. When a wire is placed in through the cap and the cap turned, the wire is terminated in a wire-receiving slot.

30 Claims, 33 Drawing Figures

INSULATION DISPLACING BARREL TERMINAL

BACKGROUND OF THE INVENTION

This application is a continuation-in-part application of pending application Ser. No. 810,794 filed Dec. 19, 1985, now abandoned, which is a continuation-in-part of Ser. No. 672,554 filed Nov. 19, 1984, now abandoned.

FIELD OF THE INVENTION

The invention relates to an insulation displacement terminal utilizing a wire receiving opening in line with a longitudinal wire slot, wherein placing a wire in the wire receiving opening and rotating the wire relative to the terminal, terminates the wire in the wire receiving slot.

DESCRIPTION OF THE PRIOR ART

There are many instances where terminal blocks are set up in high density arrays. Many of these terminal blocks are simply threaded members fixed with insulation material which receive wires either wrapped around the threaded members and secured thereto by an application of a nut or the wires are terminated by known spade or ring terminals and then secured to the threaded member by a nut. While these have, in some instances, provided effective means for termination, they have not always been convenient for maintenance or repair and they frequently are subjected to environmental degradation with a resulting loss of desired electrical characteristics.

There is a need, predominantly within the telecommunications industry for reusable terminals, and terminals which can accommodate more than one conductor size. The telephone wires coming from the phone company can either be in the form of buried cable or aerial wires. The high density arrays would be mounted in either an enclosure on the aerial mount or on an enclosed pedestal affixed to the ground. As new telephones are installed in a selected locality, the phone wires are then terminated to the respective terminals on the high density array. The wire sizes within the industry are not always the same guage and therefore the terminals must be designed to accommodate more than one wire size. A typical size wire running from the high density array to the phone installation is steel wire with a gauge of 18½ AWG, although, other phone installations use copper wire having a guage of 23 AWG. It can be appreciated then, that a terminal having a higher quality means for terminating conductors and having means to accommodate more than one wire size, would be a substantial improvement within the industry. U.S. Pat. No. 4,431,247 shows an insulated terminal and module, however the shell of the terminal is single thickness of stamping and it also utilizes a one-wire opening for insulation displacement.

SUMMARY OF THE INVENTION

The present invention utilizes insulation displacing technology to enable termination of a number of wire sizes in an environmentally protective manner with the termination being reusable and requiring only a common tool. The present invention, which can have a wide variety of configurations where special applications are required, consists of a barrel-shaped metal termination member which has at least one wire receiving hole with an adjacent longitudinal slot extending about the circumference of the barrel.

A cap made of a dielectric material is slidably received over the barrel and is axially rotatable when placed over the terminal. A wire receiving opening in the cap is in communication with the wire receiving opening in the terminal, and placing a wire through the cap and terminal wire receiving openings and rotating the cap with respect to the terminal, terminates the conductor of the wire in the longitudinal slot.

DESCRIPTION OF THE PREFERRED EMBODIMENTS

Figure 1:
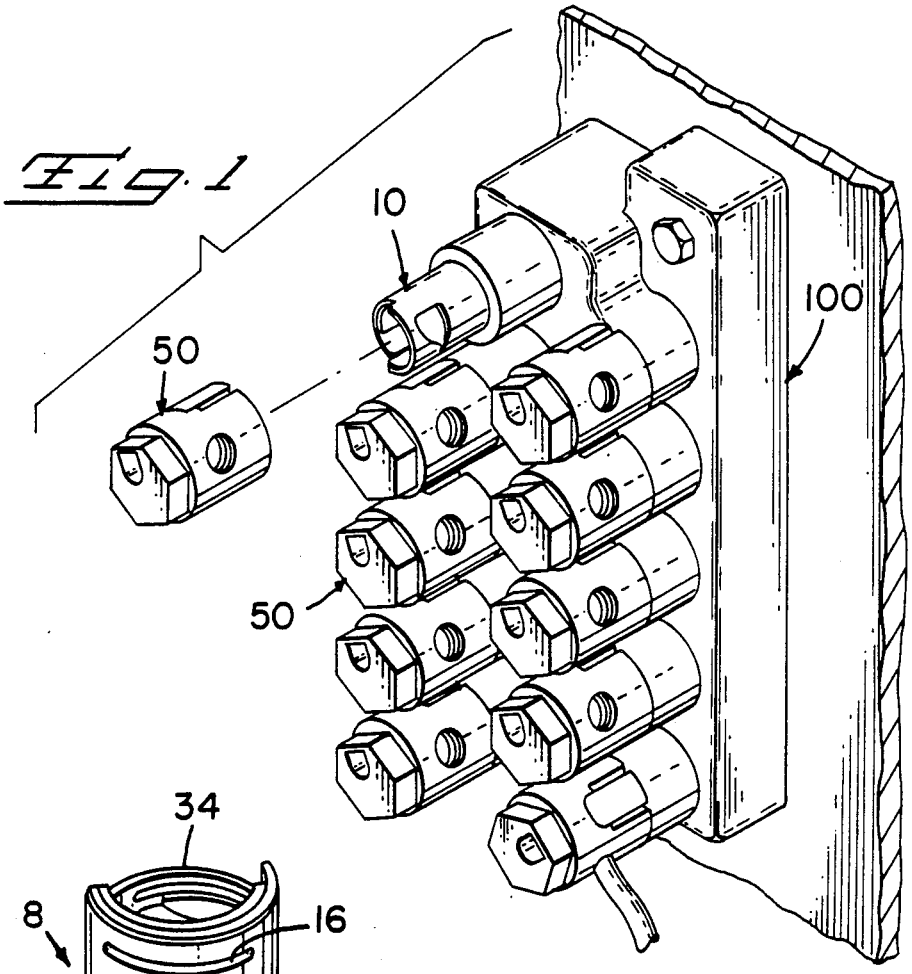
FIG. 1 is a perspective view partially exploded showing a high density array of terminals and caps.

Referring to FIG. 1, the subject invention is a cylindrically shaped insulation displacement terminal including a mating rotatable cap for terminating a conductor in the insulation displacement contacts. The terminal includes an upper insulation displacement portion 8 and lower insulation displacement portion 6. The subject terminal is stamped from a metal having good conductive qualities as good conductive qualities are needed for the body of the terminal because two signal-carrying wires are terminated to the terminal and the signal is carried through the body of the terminal.

Figure 7:
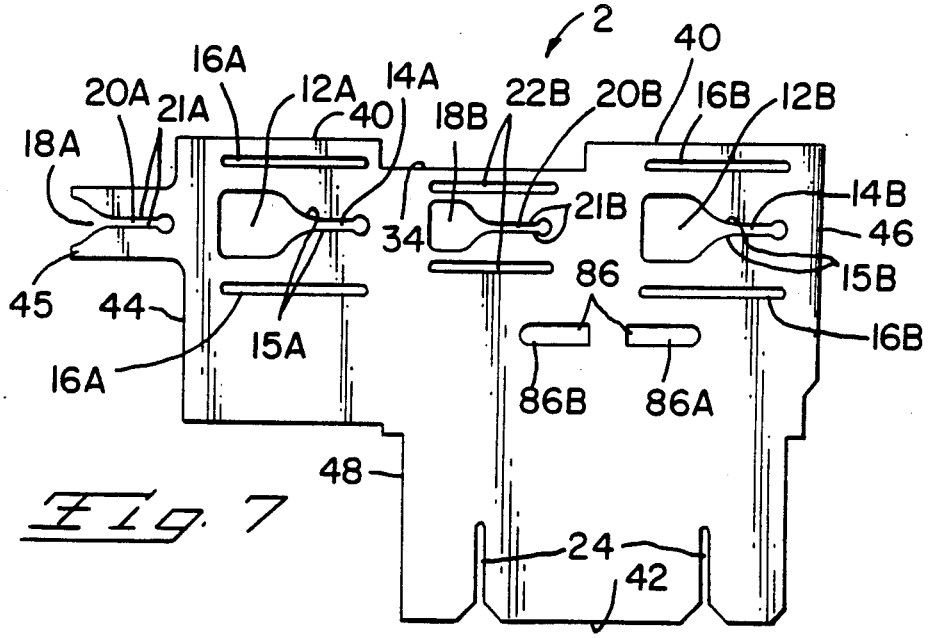
FIG. 7 is a stamped blank prior to being rolled into a barrel terminal.

Referring now to FIG. 7, as stamped, the blank 2 has top bearing surfaces 34 and 40, forward surface 44, a tab 45 on forward surface 44, a bottom surface 42 and a recessed surface 48. The blank 2 includes an inner small wire opening 18A in tab 45, the opening 18A being in transition with an inner small wire receiving slot 20A defined by sheared surfaces 21A. The blank 2 includes an inner large wire receiving opening 12A in transition with an inner large wire receiving slot 14A defined by sheared surfaces 15A, and strain relief slots 16A above and below the large wire opening 12A and large wire slot 14A. The blank 2 includes outer small wire receiving opening 18B in transition with outer small wire receiving slot 20B defined by sheared surfaces 21B, and strain relief slots 22B above and below opening 18B and slot 20B. The blank 2 includes an outer large wire receiving opening 12B in transition with an outer large wire receiving slot 14B defined by sheared surfaces 15B, and strain relief slots 16B above and below the opening 12B and slot 14B. The blank 2 further includes lower insulation displacement slots 24, and cap detention slots 86A and 86B.

Figure 8:
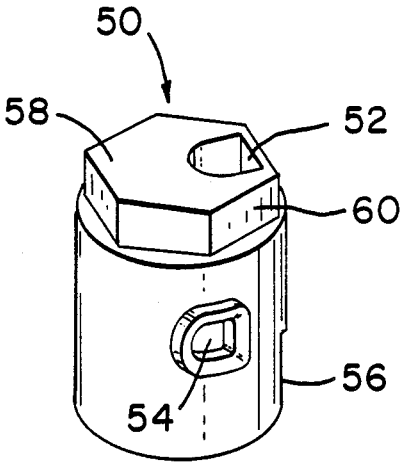
FIG. 8 is a perspective view of the terminating cap.
Figure 9:
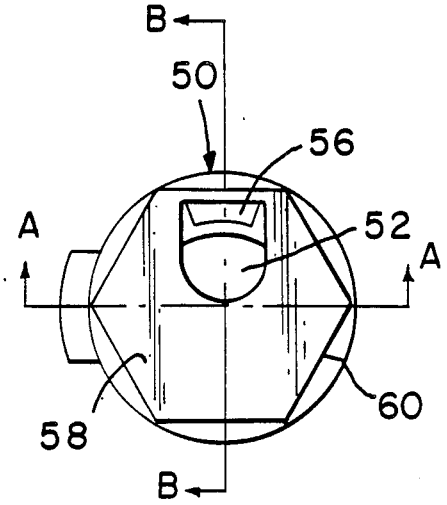
FIG. 9 is a top view of the terminating cap.
Figure 10:
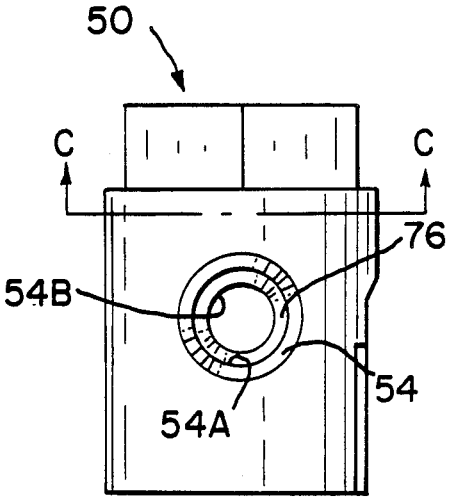
FIG. 10 is a side view of the terminating cap.
Figure 11:
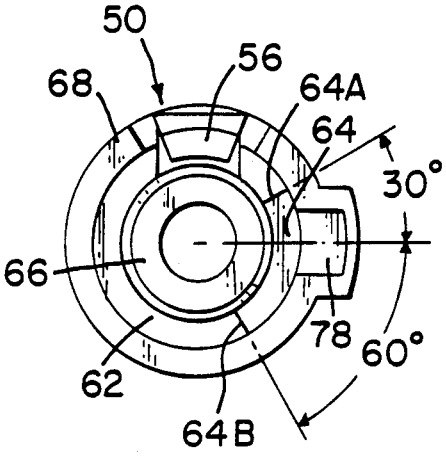
FIG. 11 is a bottom view of the terminating cap.
Figures 12A, 12B:
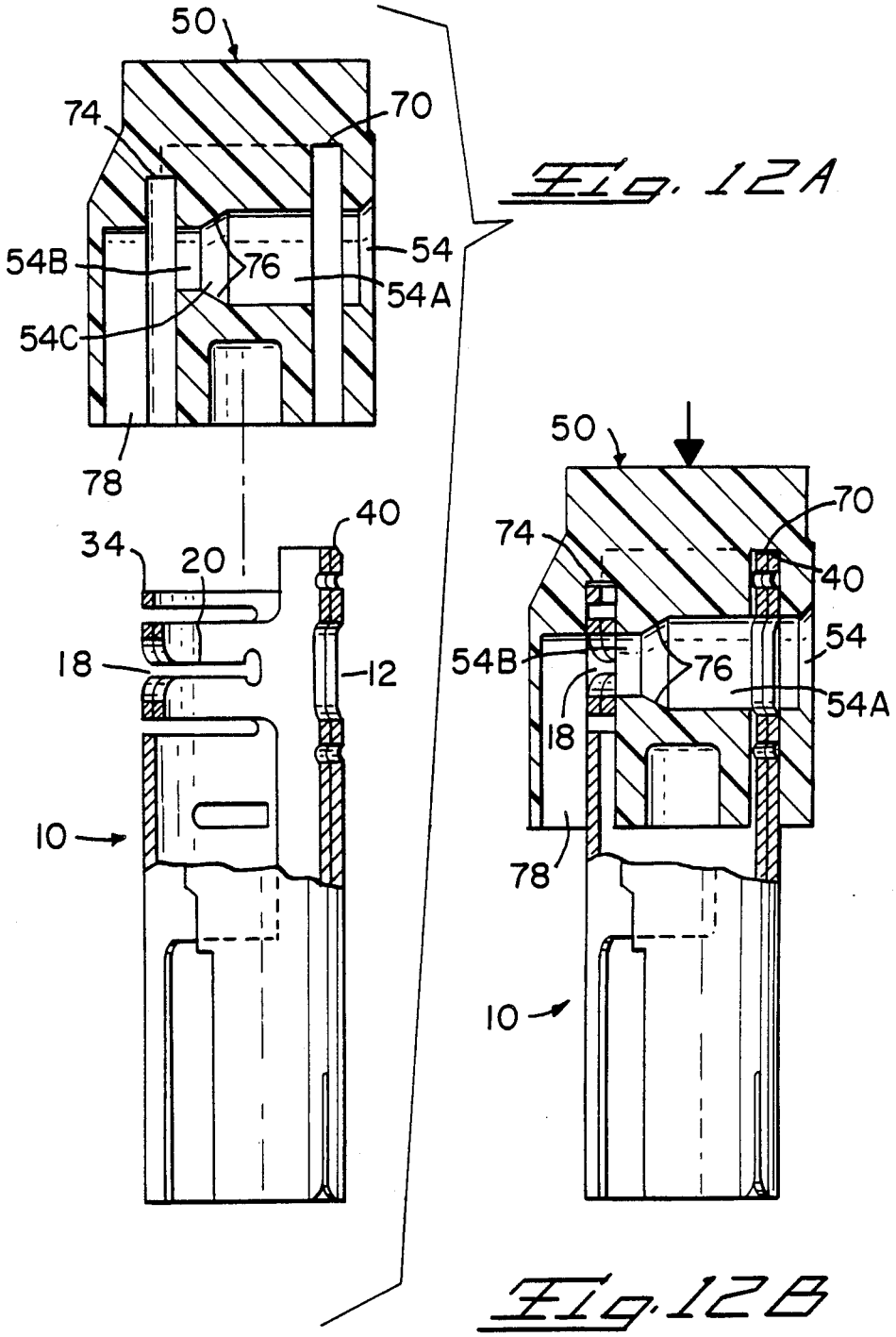
FIG. 12A shows a cross-sectional view of the terminating cap taken through lines A—A of FIG. 9 and a cross-sectional view of the terminal through lines D—D of FIG. 5.
FIG. 12B shows the cross sections of FIG. 12A in a mated relationship.
Figure 18:
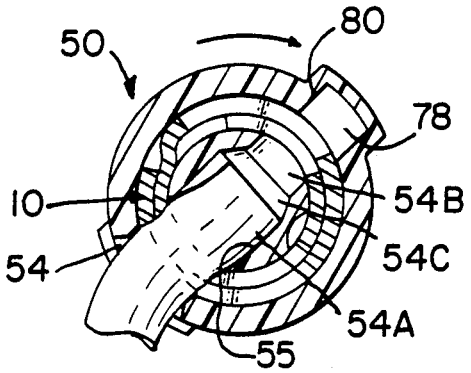
FIG. 18 shows a cross-sectional view of the large wire within the cap and terminal after termination.

The terminating cap 50, as shown in FIGS. 8 and 11, is molded from a dielectric material and includes an outer wall 68 and an inner wall 66 interconnected by a top wall 58; the inner and outer wall defining an inner circular channel 62. As shown in FIG. 11, the cap 50 further comprises rotational lug 64 having surfaces 64A and 64B, detent latch member 56 and small wire receiving channel 78. As shown in FIG. 8, the cap 50 includes hexagonal nut portion 60, continuity test hole 52 and wire entry hole 54. As shown in FIG. 12A, wire entry hole 54 has large wire entry portion 54A, small wire entry portion 54B, 54A and 54B being connected by a conical transition section 54C, being defined by surface 76. As shown in FIGS. 11 and 12A, bearing surface 74 is the lower surface of rotational lug 64 whereas bearing surface 70 is the upper surface of inner channel 62. As best shown in FIG. 18, small wire receiving channel 78 in cap 50 has a side wall 80, and section 54A of wire receiving hole 54 has a side wall 55.

Figure 2:
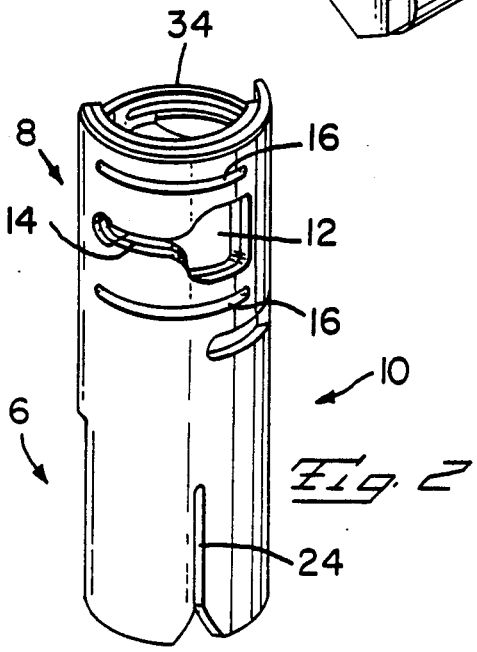
FIG. 2 is a perspective view of the subject terminal showing the large wire receiving opening.
Figure 3:
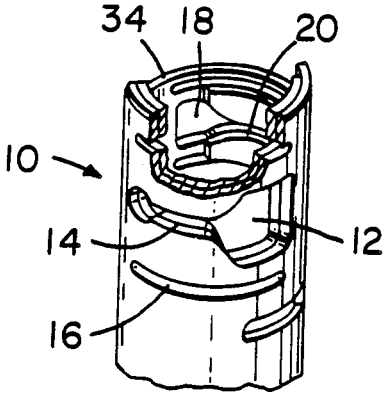
FIG. 3 is a perspective view similar to that of FIG. 2, partially cut away to show the small wire receiving opening.
Figure 5:
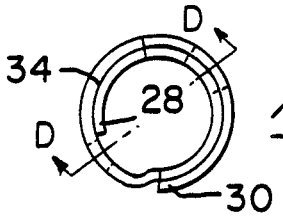
FIG. 5 is a top view of the barrel insulation displacement terminal.
Figure 4:
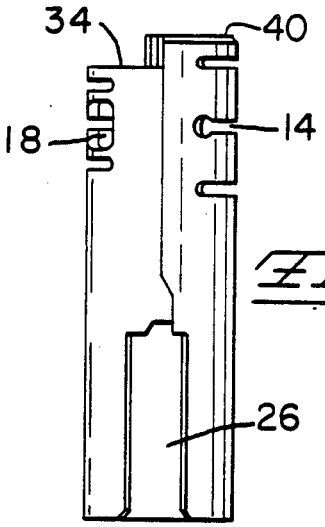
FIG. 4 is a side view of the barrel insulation displacement terminal.

The terminal 10 is formed by rolling the stamped blank of FIG. 7 into cylindrical shape, the cylinder comprising a spiraled double wall thickness as shown in FIG. 5. As best shown in FIGS. 5 and 7, the spiral begins with the end marked 18A. The spiral is then rolled clockwise around the end marked as 18A until the outer small wire receiving opening 18B overlaps the small inner wire receiving opening 18A and continues around until the large outer wire receiving opening 12B overlaps the large inner wire receiving opening 12A. As overlapped, the outer large wire strain relief slots 16B also overlap the large strain relief slots 16A. When completely rolled, the terminal 10 is a cylinder having an inner and outer wall of twice the thickness of the metal stamping and having diametrically opposed large and small wire receiving holes, 12 and 18, respectively, as best shown in FIG. 2.

Referring now to FIG. 11, it is seen that inner circular wall 66 and outer circular wall 68 of cap 50 define inner channel 62, which is so dimensioned as to be slidably received over terminal 10; that is, the outer diameter of inner wall 66 is less than the inner diameter of terminal 10, while the inner diameter of outer wall 68 is greater than the outer diameter of terminal 10. When cap 50 is received over terminal 10, wire receiving opening 54 in cap 50 is aligned with large wire receiving opening 12 and opposed small wire receiving opening 18 in terminal 10. Completely rotating cap 50 clockwise aligns wire receiving hole 54 in cap 50 with the large wire receiving slot 14 and diametrically opposed small wire receiving slot 20.

Figure 6:
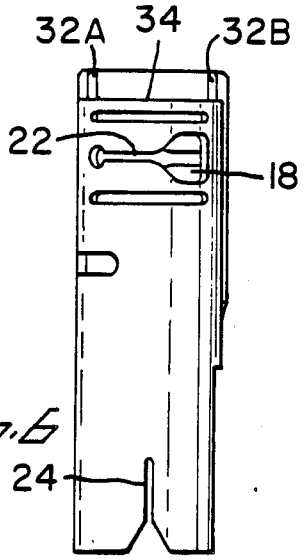
FIG. 6 is a back view of the barrel insulation displacement terminal.

When the cap 50 is received over terminal 10, surface 70 of cap 50 bears on surface 40 of terminal 10 whereas surface 74 of cap 50 bears on surface 34 of terminal 10, as shown in FIGS. 12A and 12B. Although the cap 50 and terminal 10 are rotatable with respect to one another, the angle through which the cap 50 may rotate is fixed, because as best shown in FIGS. 5 and 6, the terminal has rotational stops 32A and 32B, and the cap in turn, as shown in FIG. 11, has a rotational stop lug 64, having surfaces 64A and 64B. When the cap 50 is received over terminal 10 such that the wire opening hole 54 in the cap 10 aligns with wire opening holes 12 and 18, surface 64B of lug 64 is against surface 32B of terminal 10, and when the cap is rotated, the rotation is limited by surface 64A of lug 64 against surface 32A of terminal 10. Thus, the angle of rotation is defined by the angle of surface 34 as defined by surfaces 32A and 32B, less the included angle of lug 64, as defined by surfaces 64A and 64B, and is the angle required to terminate either the small wire or the large wire in the upper insulation displacement portion 8.

Wire receiving hole 54 in cap 50 receives either the large wire or the small wire, depending on which conductor is to be terminated. As best shown in FIGS. 12A and 12B, hole 54 extends radially through the center of cap 10, and communicates with wire opening holes 12 and 18 in terminal 10, and with small wire receiving channel 78. As best seen in FIG. 12A, hole 54 comprises a large wire section 54A, a small wire section 54B and a conical transition section 54C defined by surface 76. Hole 54 will receive either a large diameter wire or a small diameter wire and the large wire will be terminated within slot 14, whereas the small wire would be terminated within slot 20.

Figure 22A:
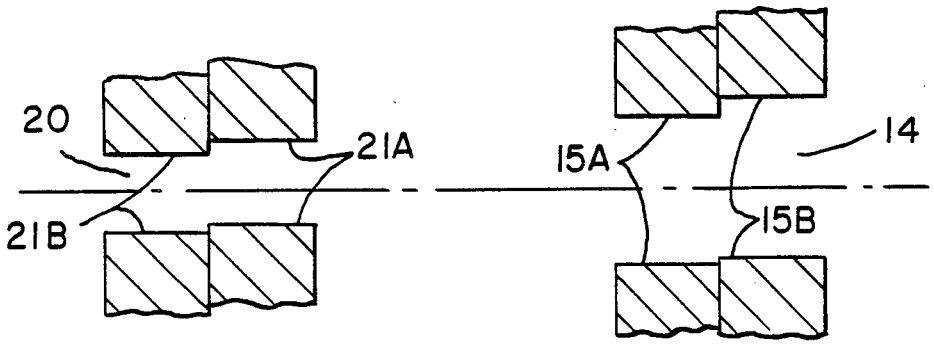
FIG. 22A is a diagrammatical sketch of the large and small wire terminating slots, taken through the axial centerline of the terminal.

Termination of either large or small wire produces a spring loaded contact between the conductor and the inner and outer wire receiving slots. As best shown in FIG. 22A, the wire receiving slots, although aligned, are slightly offset vertically. Therefore, the movement of the inner wire receiving slots with respect to the outer wire receiving slots is a coil spring effect, as the blank 2 is a double rolled spiral. When a wire is terminated within a wire receiving slot, the conductor realigns the inner and outer wire receiving slots axially and the conductor is spring loaded within the slot. Therefore, termination of either the large or small wire also produces a redundant three-point interconnection between the conductor of the wire with the wire receiving slots 14, 20. Because the small wire receiving slot 20 has overlapping inner and outer slots 20A and 20B respectively, the conductor of a small wire terminated within small wire receiving opening 20, is terminated within two slots. As best shown in FIG. 7, slot 20A is defined by sheared edges 21A, while slot 20B is defined by sheared edges 21B, and the width of slot 20A is larger than the width of slot 20B, whereas inner 14A and outer 14B slots are defined by sheared edges 15A and 15B, respectively, and inner slot 14A is slightly smaller in width than outer slot 14B, as best shown in FIG. 22A.

Figure 15:
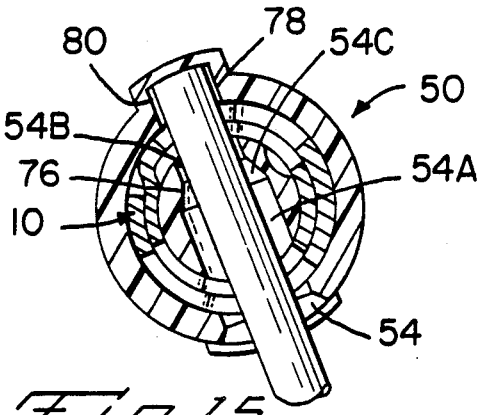
FIG. 15 shows a cross-sectional view of a small wire inserted into the cap and terminal prior to termination.
Figure 16:
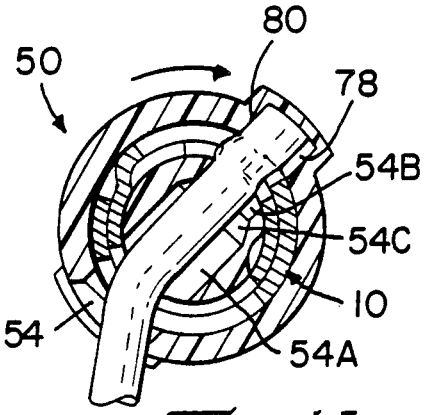
FIG. 16 shows a cross-sectional view of the small wire within the cap and terminal after termination.
Figure 17:
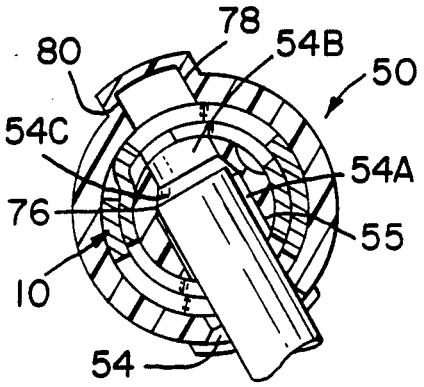
FIG. 17 shows a cross-sectional view of a large wire inserted into the cap and terminal prior to termination.
Figure 22B:
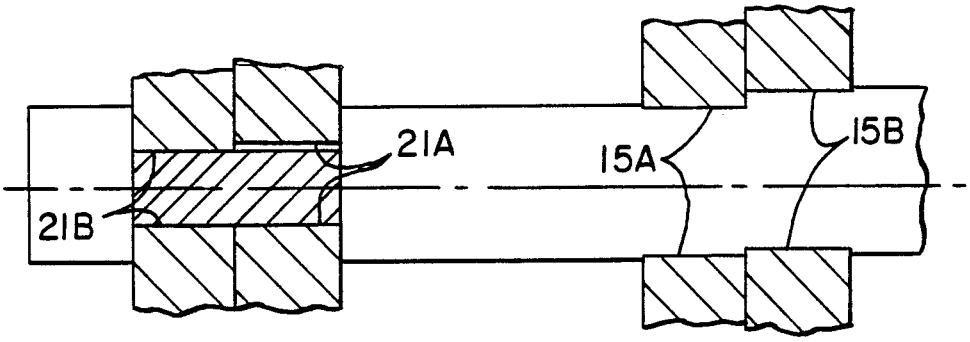
FIG. 22B is a view similar to that of FIG. 22A showing a small wire terminated within the small wire terminating slot.
Figure 22C:
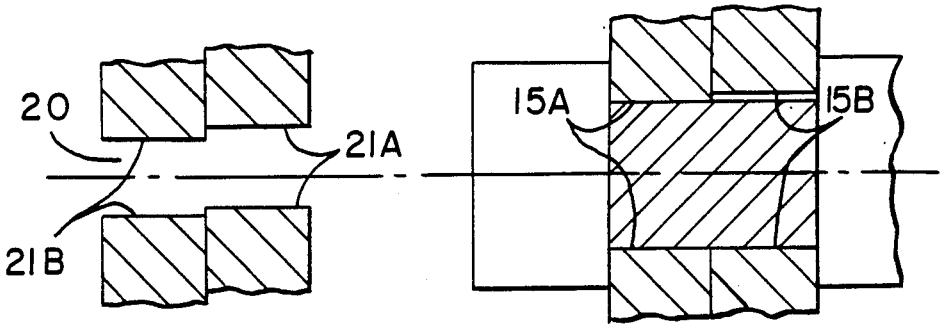
FIG. 22C is a view similar to that of FIG. 22A showing a large wire terminated within the large wire terminating slot.

If a small wire is to be terminated in slot 20, the small wire is placed in hole 54 and extends through sections 54A, 54B and 54C and into channel 78, as shown in FIG. 15. When the cap is rotated relative to the terminal, the wire is carried in the channel and side wall 80 of channel 78 forces the conductor into the small wire terminating slot 20, as shown in FIG. 16, and the small wire makes electrical and mechanical contact with sheared surfaces 21A and 21B at three points, because the width of inner slot 14A is slightly larger than the diameter of the small wire conductor, as best shown in FIG. 22B. The small wire is also rotated into slot 14, and the insulation of the small wire is gripped by slot 14, which acts as a strain relief. Conversely, when a large wire is placed in hole 54, the large wire is precluded from entering section 54B, but remains in section 54C, bearing against surface 76 of section 54C, as shown in FIG. 17. When the cap is rotated relative to the terminal, the large wire is carried within hole 54 and surface 55 forces the large wire into the large wire receiving slot 14, as shown in FIG. 18, and the large wire makes electrical and mechanical contact with sheared surfaces 15A and 15B at three points, because the width of outer slot 14B is slightly larger than the diameter of the large wire conductor, as best shown in FIG. 22C.

Figure 13:
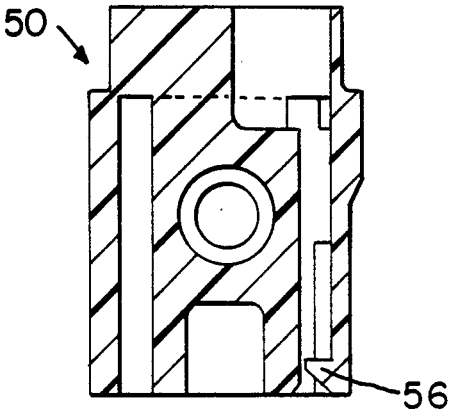
FIG. 13 is a cross-sectional view taken through lines B—B of FIG. 9.
Figure 14:
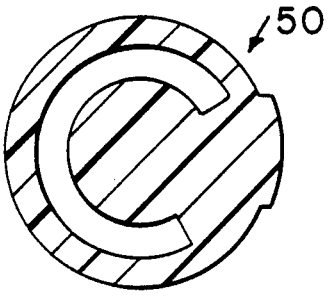
FIG. 14 is a cross-sectional view taken through lines C—C of FIG. 10.

When the cap 50 is placed over the terminal 10, strain relief latch 56, as best shown in FIG. 13, is engaged in latch slots 86, as best shown in FIG. 7. When the cap 50 and terminal 10 are blank, the latch 56 is engaged in slot 86B and merely retains the cap onto the terminal 10. When a wire is terminated within terminal 10 and cap 50 is rotated, latch 56 is engaged with slot 86A, acting as a strain relief and cap positioning device, precluding axial movement of cap 50 relative to terminal 10.

Both the large and the small wire receiving slots 14 and 20, respectively, have strain relief slots 16 and 22 both above and below the respective receiving slot. As the wire is terminated in the wire receiving slot, stress is accumulated in the end of the wire receiving slot and the strain relief slots are meant to relieve that stress and thereby preclude a crack in the wire receiving slot.

Terminating a wire in the large or small wire receiving slot 14, 20 could also cause a turning of the terminal within the array. Therefore an antirotation slot 26 fits into an antirotation peg 106, within block 100, as shown in FIG. 19, such that any torsion applied to the terminal 10, during termination, is applied to the block 100, preventing the rotation of terminal 10.

Figure 19:
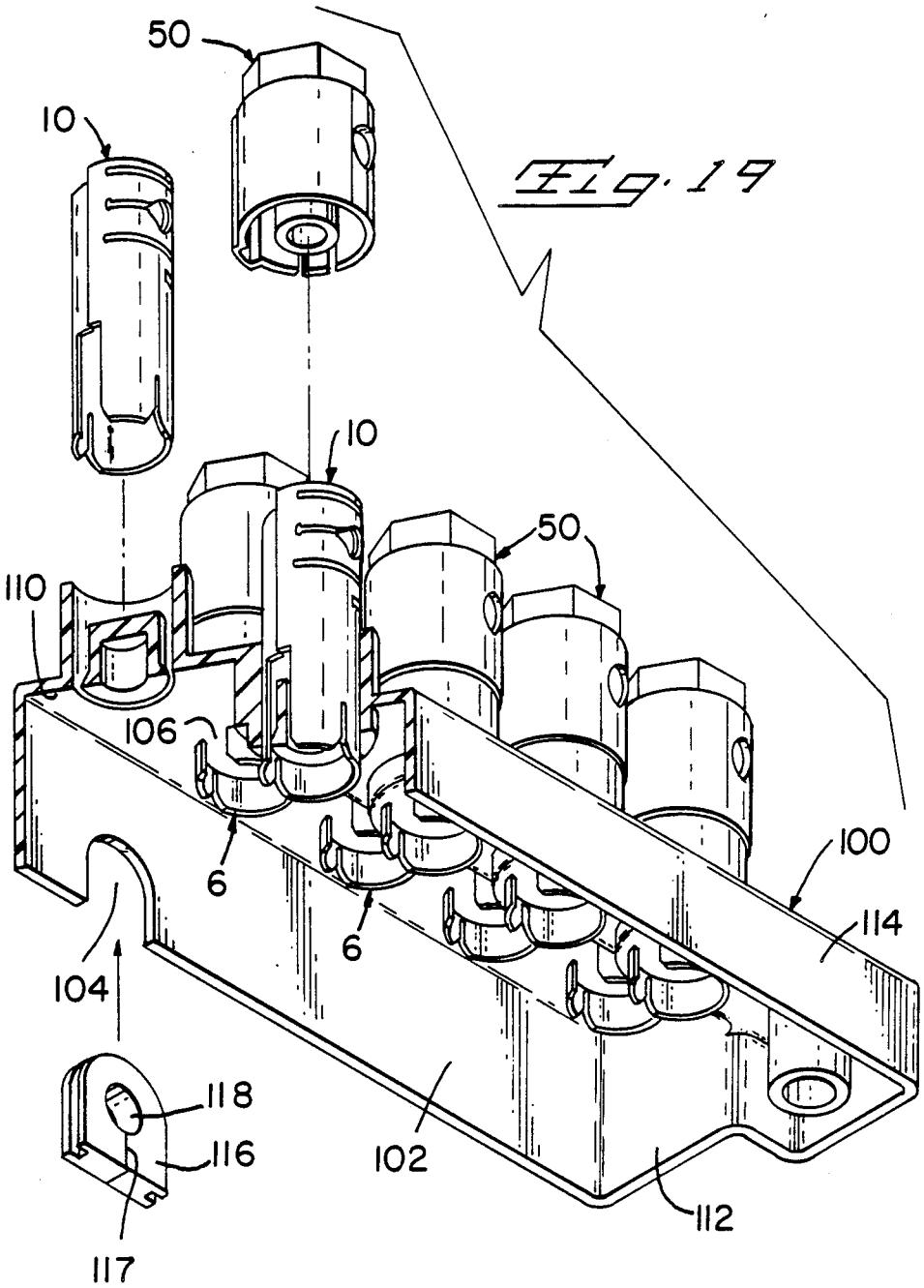
FIG. 19 shows a perspective view of the bottom of the terminal array.
Figure 20:
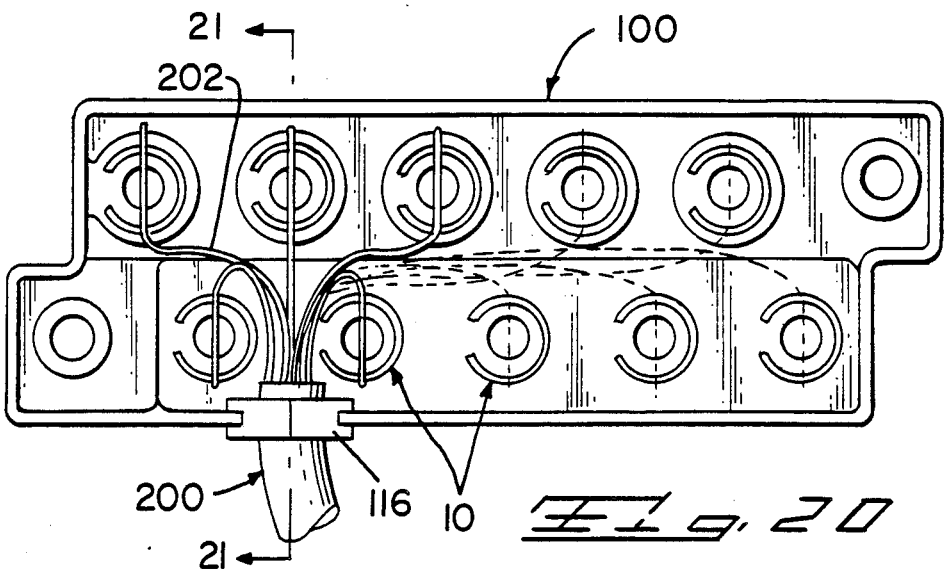
FIG. 20 shows a bottom view of the terminal array with individual wires of a multiconductor cable terminated to the lower insulation displacement portions of the terminals.
Figure 21:
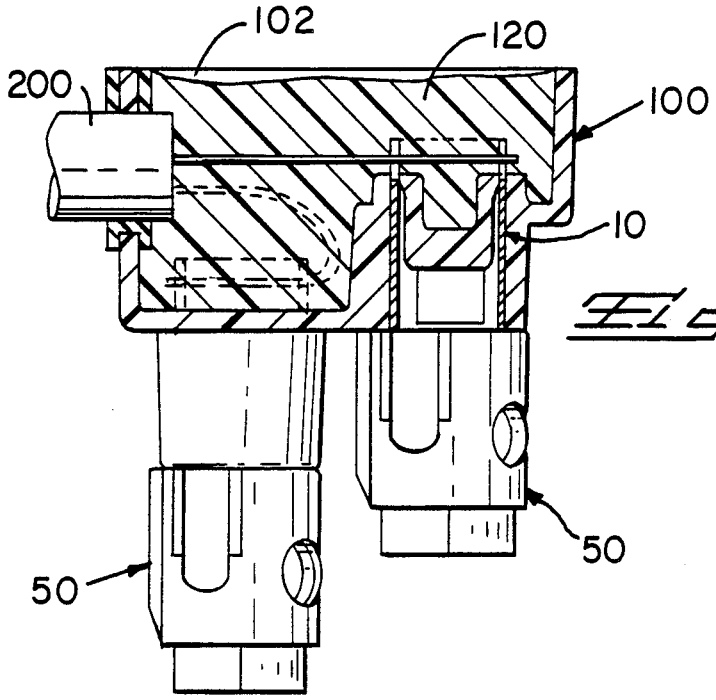
FIG. 21 shows a cross-sectional view of the terminal array taken through lines 21—21 of FIG. 20 showing the cavity filled with a waterproof epoxy.

The terminals are prepared for field use by first installing several cylindrical terminals within a mounting block 100, as shown in FIG. 19. Plug 116, having slit 117, is then wrapped around a cable 200, cable 200 lying in hole 118 and then the plug 116 is fed into slot 104. A single wire is then terminated to each lower insulation displacement slot 24, in a conventional manner, as shown in FIG. 20. As best shown in FIG. 19, mounting block 100 has a base wall 110, end walls 112 and side walls 114. With the mounting block 100 in a configuration such that the caps and terminals are facing downwardly, the upstanding side walls 114 and end walls 112 form a cavity 102, with the upstanding walls higher than the protruding portion of the lower insulation displacement portion 6, as best shown in FIG. 21. To environmentally protect the lower terminations, an epoxy resin 120 is poured into the cavity 102 to completely cover the lower insulation displacement portions 6 and the wires 202, as best shown in FIG. 21. Plug 116 retains the epoxy 120 in the cavity 102 until the epoxy has cured and also acts as a strain relief member protecting the wire terminations from tensile force on the cable 200.

The array is then ready for field pedestal installation, the mounting block is installed within an enclosed aerial mounting box, or is mounted within a ground level mounting box. The individual wires 202 of the multiconductor cable 200 are then connected to corresponding wires of the phone company, either the buried cable or aerial drop wires. Several installed terminal arrays provide a convenient and environmentally protective means for field connection of telephone wires; that is, as new telephone installations are required, the wires required for the new installation can simply be fed through the wire receiving opening in the cap and the wire terminated. When terminated to the upper insulation displacement portion 8, the conductor is redundantly terminated in both insulation displacement slots in adjacent walls of the double-walled terminal.

Figure 23:
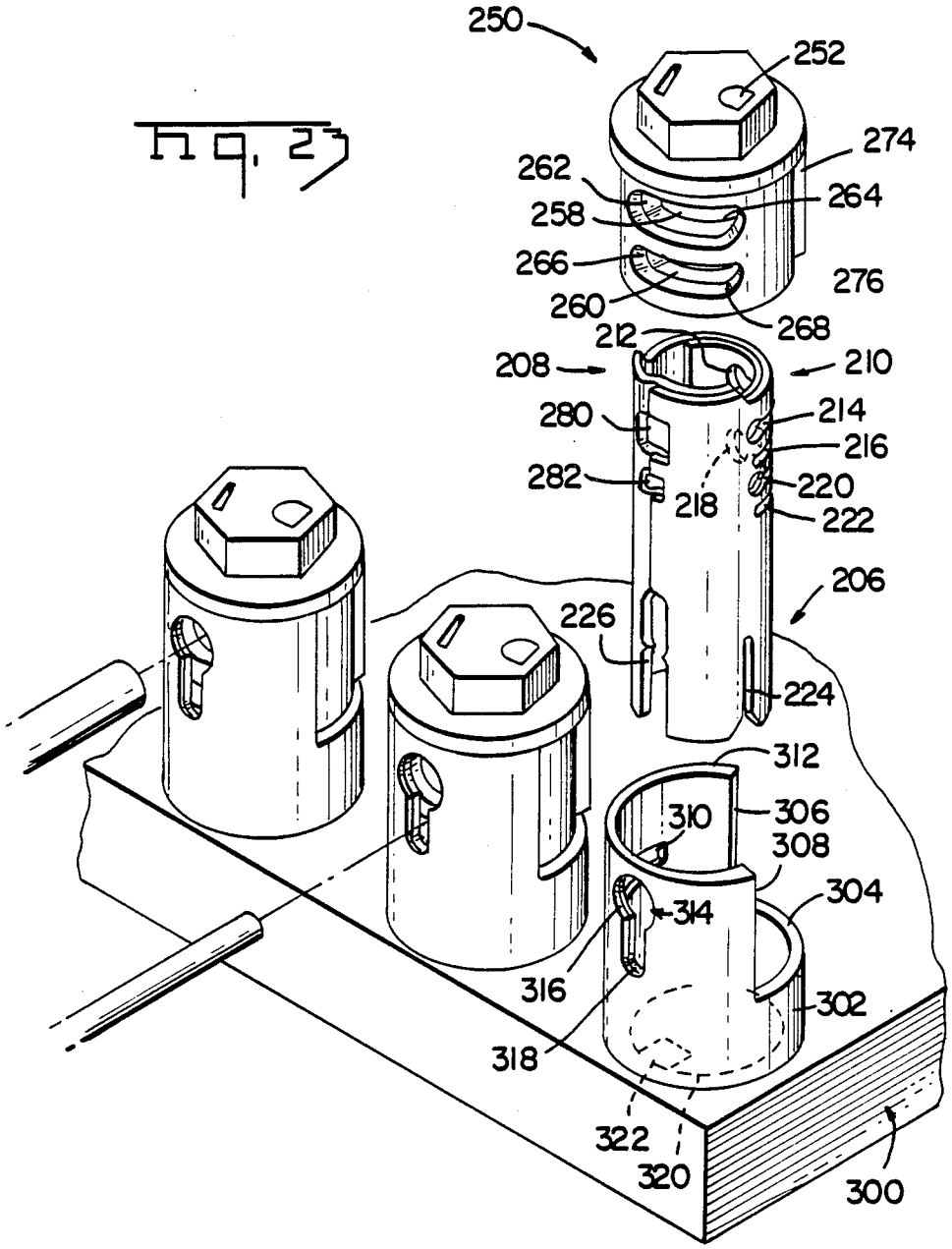
FIG. 23 is a perspective view of a second embodiment of the instant invention showing a large and small wire poised for receipt in respective wire entries, and a terminal and cap exploded from the tubular extension.

A second embodiment of the instant invention is shown in FIG. 23 as including a mounting block 300 having a plurality of tubular extensions 302 upstanding from the mounting block 300, and a plurality of cylindrical terminals 210 and a plurality of rotatable caps 250. The second embodiment shown in FIG. 23 is also capable of terminating a large and a small wire, the preferred embodiment of the instant invention being profiled to terminate an 18½ AWG steel wire and a 23 AWG copper wire.

Each of the tubular extensions 302 are integrally formed with the mounting block 300 and upstand from the base of the mounting block 300. The tubular extension basically comprises an annular wall having an upper edge 312. A radial segment is removed from the tubular extension 302 for a portion of its length and is defined by a first edge 306, a second edge 308, and a lower edge 304. The tubular extension 302 also comprises an inner ring 320 profiled with a diameter to receive the terminal 210 therein. The ring 320 includes a mounting lug 322. The tubular extension 302 further comprises a detent aperture 310 and a keyhole slot 314. The keyhole slot 314 extends generally longitudinally with the length of the extension 302 and comprises a large hole portion 316 and a narrow slot portion 318.

The terminal 210 is similarly designed to the terminal of the first embodiment in that it is spirally wrapped to form a double wall thickness. The terminal 210 includes an upper insulation displacement portion 208 and a lower insulation displacement portion 206 comprising an insulation displacement slot 224. The upper insulation displacement portion 208 includes a large wire entry 212 in communication with a large wire receiving slot 214, and a small wire receiving entry 218 in communication with a large wire receiving slot 220. Each of the large and small wire receiving portions include respective strain relief slots 216, and 222. The terminal 210 differs from the first embodiment in that the large and small wire terminating sections are vertically disposed one above the other with the large wire entry 212 and the small wire entry 218 in vertical alignment. Terminal 210 further comprises a large wire access 280 and a small wire access 282 diametrically opposed from respective large wire entry 212 and small wire entry 218.

Figure 24B:
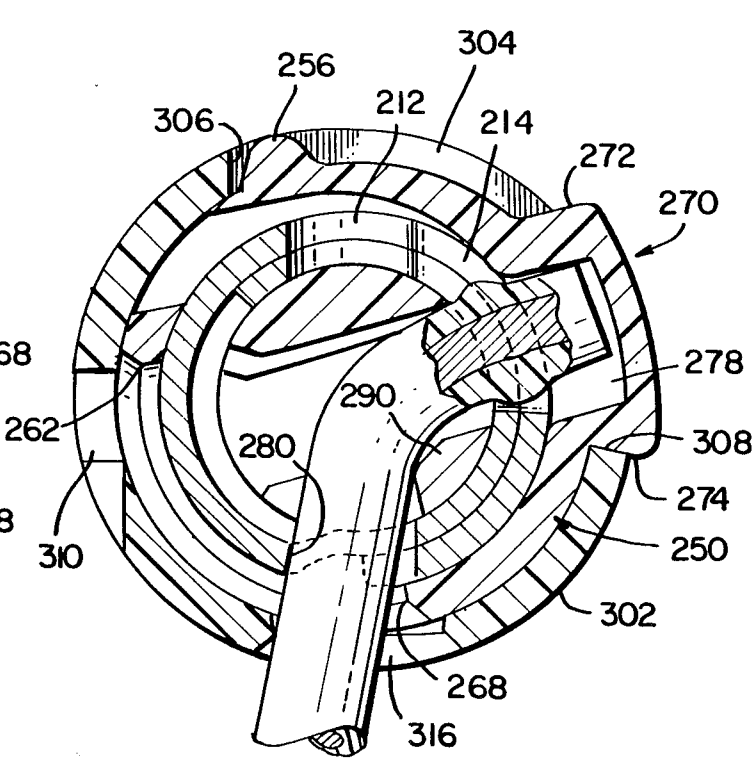
FIG. 24B is a view similar to that of FIG. 24A showing the wire and terminal in the terminated condition.
Figure 24A:
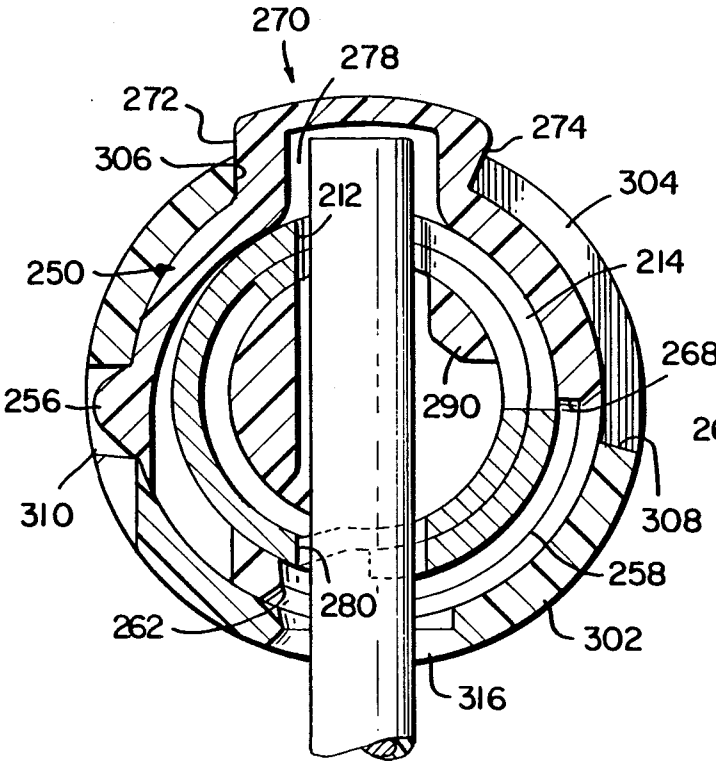
FIG. 24A is a cross-sectional view through the small wire receiving portion showing the wire inserted and in the unterminated condition.

As best shown in FIGS. 24A and 24B, the cap 250 has a similar channel portion 270 as that of the first embodiment comprising an inner channel portion 278, outer edges 272 and 274 and a lower edge 276. As the large and small terminating sections of terminal 210 are vertically disposed one above the other, two wire receiving openings are required in the cap 250, a large wire receiving portion 258 and a small wire receiving portion 260.

Referring again to FIG. 23, the terminal 210 is placed within the tubular extension 302 fitting within the ring 320 such that the slot 226 is slidably received over the lug portion 322 preventing the terminal from rotating during the termination of the wire. It should be noticed that the terminal 210 is profiled to be received within the tubular extension 302 but the outside diameter of the terminal 210 is not as large as the inside diameter of the extension 302, thus providing a gap between the terminal 210 and the inside portion of the extension 302. The cap 250 generally comprises an annular wall which is profiled to slidably be received over the terminal 210 but within the tubular extension in the gap as previously described. The cap 250 is placed within the tubular extension such that the channel portion 270 is within the cutout portion of the tubular extension between edges 306 and 308. The cap is lowered onto the terminal until the lower edge 276 of the chanel portion 270 abuts the bottom edge 304 of the cut away portion of the extension 302. When the cap 250 is placed over the terminal such that the outside edge 272 abuts the edge 306 of the tubular extension (FIG. 24A), the detent 256 on the outer surface of the cap 250 is disposed within the detent aperture 310 of the tubular extension 302. This detent provides a deterrent for axial removal of the cap 250, and as a deterrent for the rotation of the cap 250, thereby preventing the loosening of an electrical termination. Also when the edge 272 of the channel member 270 is abutting the side edge 306 of the extension 302, the left-hand portion of the slot 258, the large hole 316 of the keyhole slot 314, the large access 280, the large wire entry 212 and the internal channel 278 are all in alignment. Likewise, the narrow slot 318, the left-hand portion of the slot 260 of the cap, the small access hole 282 of the terminal, 210, the small wire entry 218, and the internal channel 278 are all in alignment.

The cap 250 is rotatable between the extremes shown in FIGS. 24A and 24B, that is, between the interference of the channel member 270 and the side edges 306 and 308 of the extension 302. Thus with the cap in its full counterclockwise position as shown in FIG. 24A, either a large wire or a small wire can be inserted into the respective wire entries and the cap rotated until the edge 274 of the channel member abuts edge 308 of the extension which terminates either a small wire or a large wire in the respective wire receiving slots. The termination of either the small or large wire in the respective wire receiving slots of the second embodiment produces a result similar in effect to that shown in FIGS. 22A through 22C. As the wire receiving slots are axially offset, the termination of either wire would produce a three point redundant contact with the respective large or small conductor. The difference is that in the second embodiment, the wire receiving slots and openings are vertically disposed one above the other, as shown in FIG. 23, whereas the first embodiment has the large and small wire receiving openings and slots diametrically opposed.

As best shown in FIGS. 24A and 24B, the front portion of either wire is not bent at the location where the wire is located at the keyhole slot 314, but rather the wire is bent at the portion where the wire extends into the channel 278. This is due to the fact that the large slot 258 in the cap 250 extends between ends 262 and 264 of slot 258 and slot 260 extends between ends 266 and 268. Thus as shown in FIG. 24A, when in the unterminated condition, the end 266 of the small slot is disposed adjacent to the wire but when terminated, as shown in FIG. 24B, the end 266 of the slot is rotated away from the wire and now end 268 is disposed adjacent to the wire. Thus the slots in the cap allow the cap to rotate about the wire leaving the wire at the forward location stationary. The wire is, however, terminated and rotated into one of the respective wire receiving slots 214, 220, as shown in FIG. 24B. This kink is the wire (FIG. 24B) around the lug 290, which is integral with the cap 250, provides for an excellent strain relief in the event the wire is pulled from the exterior of the cap 250, as the strain in the wire is transferred to the lug 290 and not on the electrical termination.

Figure 25:
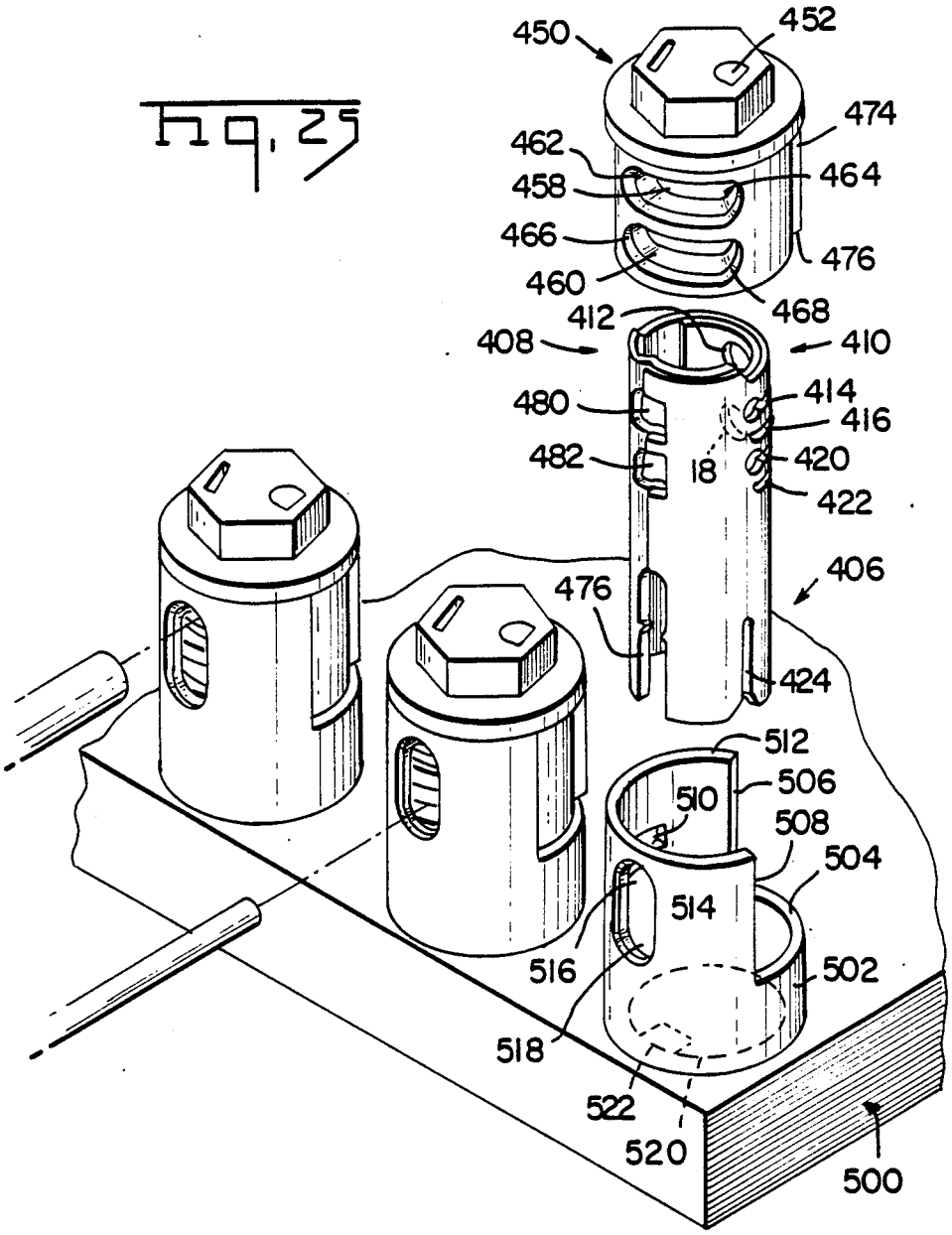
FIG. 25 is a perspective view of a third embodiment of the instant invention similar to FIG. 23.

Referring now to FIG. 25, a third embodiment is shown as including a mounting block 500 with tubular extension 502 extending upwardly therefrom. The tubular extensions 502 are similar to that of the second embodiment having a partial slot extending between surfaces 506 and 508. The opening 514 in the tubular extension, however, is an oblong hole of a common width having an upper portion 516 and a lower portion 518. In the preferred version of the third embodiment, the oblong opening is wide enough to receive an 18½ AWG wire.

Terminal 410 is similar to the terminal 210 of the second embodiment, in that the wire receiving openings and wire receiving slots are vertically disposed one above the other. The difference between terminals 410 and 210 is that the upper and lower wire receiving entries 412, 418, respectively, are each profiled for terminating different size wires. In the preferred version of the third embodiment the wire receiving slots 414, 420 can either terminate a 23 AWG or an 18½ AWG wire, or any wire between the range of these two extremes. Upper wire receiving entry 412 is in communication with wire receiving slot 414 and the lower wire receiving entry 418 is in communication with the wire receiving slot 420. The upper and lower wire accesses 480 and 482, respectively, are diametrically opposed from the upper and lower wire receiving entries 412, 418. The cap 450 of the third embodiment is also similar to the cap of the second embodiment, however, each of the rotation slots 458, 460 have a common width. In the preferred version of the third embodiment, that width is large enough to accommodate an 18½ AWG wire. The channel member 470 includes side edges 472, 474 and a lower edge 476.

The terminal 410 is disposed within the tubular extension with the terminal slot 476 being slidably received over the lug 522 of the tubular extension and slidably received in the circular access hole 520. As in the second embodiment, the outer diameter of the terminal 410 is smaller than the inner diameter of the tubular extension, leaving a gap therebetween. The cap 450 generally comprises an annular wall of a thickness such that the cap can be slidably received over the terminal yet between the inner diameter of the tubular extension 502. The cap is slidably received over the terminal until the lower portion of the channel 476 abuts the edge 504 of the tubular extension. Once again the cap is rotatable to the extent of the interference between edges 472 of the channel against edge 506 of the tubular extension and between side edge 474 of the channel and edge 508 of the tubular extension.

Figure 27:
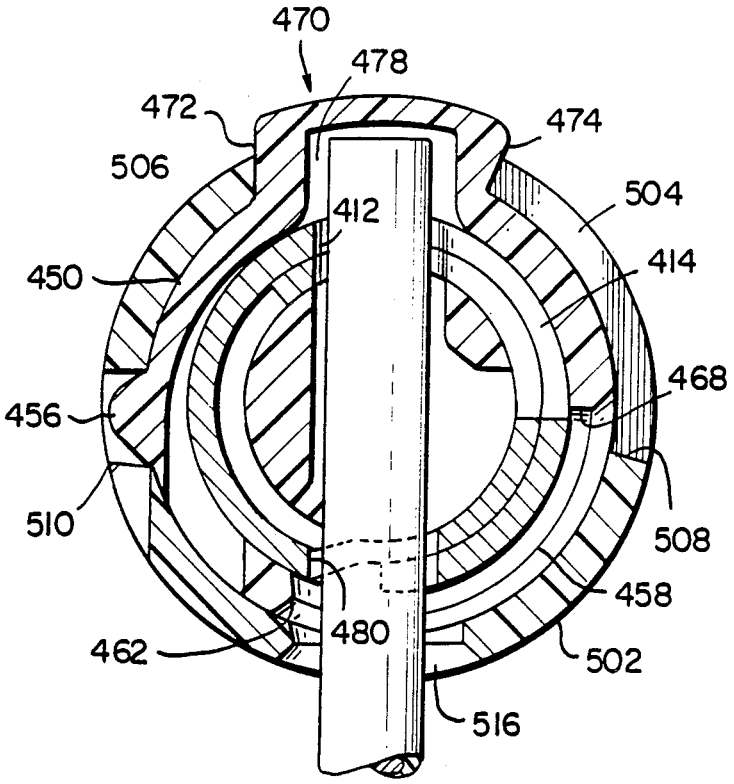
FIG. 27 is a cross sectional view of the third embodiment through the upper wire receiving opening.

As assembled, the third embodiment can terminate either an 18½ AWG or a 23 AWG wire through either of the wire receiving slots 414 or 420. When the cap 450 is in its full counterclockwise position, as shown in FIG. 27, such that the side edge of the channel 472 abuts the edge 506 of the tubular extension, the upper portion 516 of the slot 514 in the tubular extension 502 is in alignment with the left hand portion of the upper slot 458, in alignment with the wire access 480, and in alignment with the wire receiving entry 412 of the terminal 410 and in alignment with the inner access 478 of the channel 470. Likewise, the lower portion of the wire entry slot 518 in the tubular extension 502 is aligned with the left hand portion of the lower slot 460 in the cap 450, with the wire access 482 in the terminal, with the lower wire entry 418 in the terminal, and with the inner channel 478.

Figure 26A:
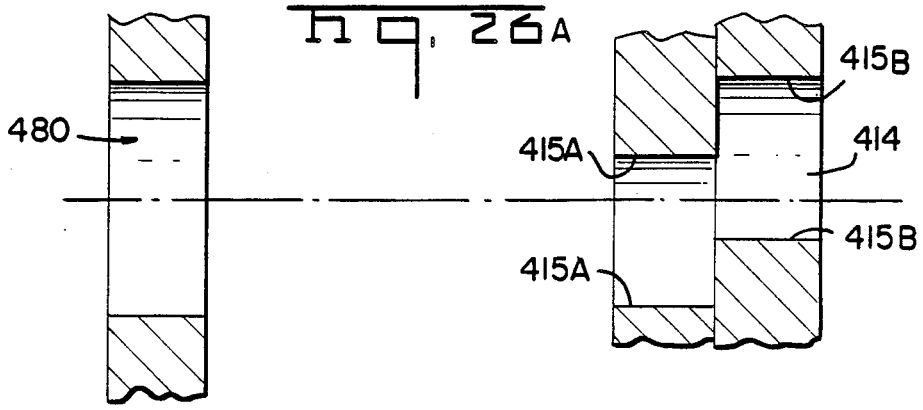
FIG. 26A is an instantaneous cross sectional view through the axial centerline of the terminal showing the cross section of the adjacent and axially offset slots.

As shown most clearly in FIG. 26A, the upper wire receiving slot 414 is defined by a pair of sheared edges 415B on the outside plate and a pair of sheared edges 415A on the interior plate. Although the slot edges 415A and 415B could be spirally located to axially offset the slots in any manner, as shown in FIG. 26A, the preferred version of the third embodiment is to locate the inner sheared edges 415A below those of sheared edges 415B. In order to accommodate two different diameters of conductors, the wire receiving slot 414 has to be small enough to engage the conductor of the small wire yet large enough to accommodate the conductor of the large wire. In other words, the distance between the two closest sheared edges must be less than the diameter of the smallest conductor to be terminated. As shown in FIG. 26A, the smallest distance between the two closest sheared edges is the distance between the upper sheared edge 415A and the distance between the lower outside sheared edge 415B, which is shown as $X_1$.

Likewise, in order to terminate a large conductor, the distance between sheared edges in the same plate must interferingly fit with the conductor. As shown in FIG. 26A, the distance between the two sheared edges 415A is shown as $X_2$.

Figure 26B:
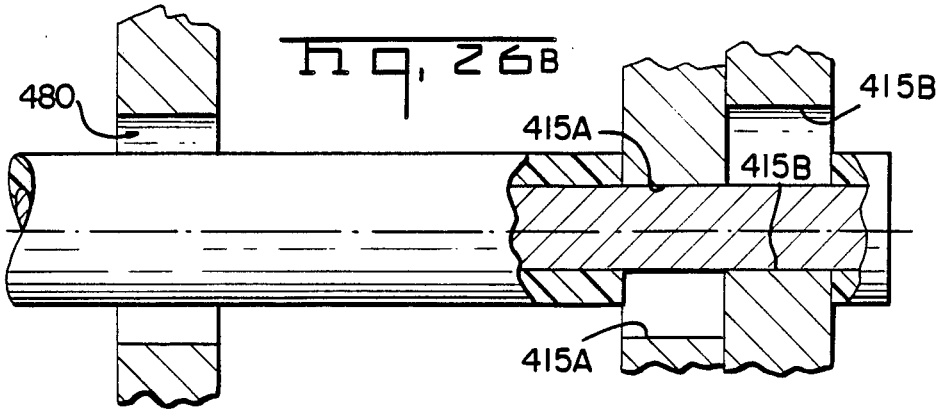
FIG. 26B is similar to that of FIG. 26A showing a small conductor terminated within the insulation displacement slot.

To terminate a small wire, the wire is placed in either of the opening portions 516, 518 and through either of the wire accesses 480 or 482 which will place the wire into one of the wire receiving entries 412, 418. Upon rotation of the cap 450, as in previous embodiments, the wire is rotated into the wire receiving slot 414 as shown in FIG. 26B. As the distance between the two closest sheared edges $X_1$ is smaller than the diameter of the conductor of the small wire, the spirally wrapped walls will realign themselves to provide resilient contact between upper sheared edge 415A and lower sheared edge 415B with the conductor. Similarly, to terminate a large wire, the large wire is placed through one of the wire entries 516, 518 and through to one of the wire entries 412, 418, where rotation of the cap disposes the conductor of the wire into the wire receiving slot 414.

Figure 26C:
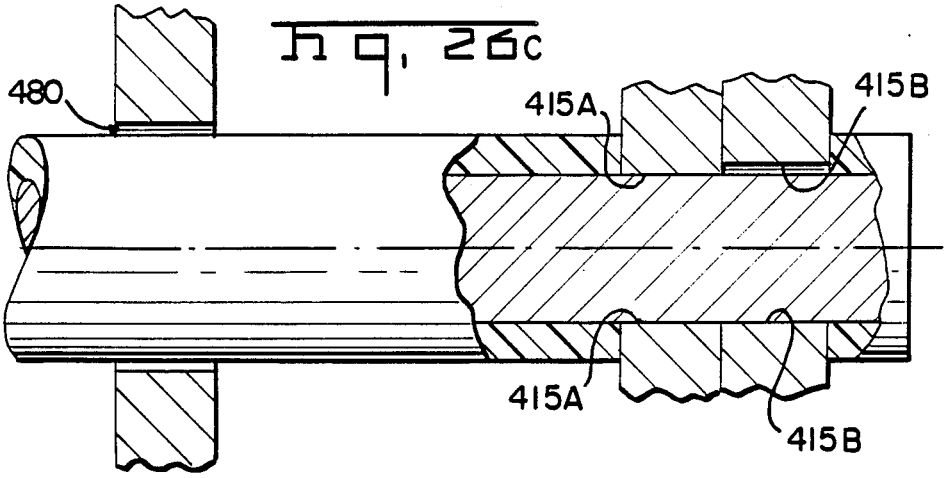
FIG. 26C is similar to FIG. 26A showing a large conductor terminated within the insulation displacement slot.

As shown in FIG. 26C, the inner and outer slots axially realign themselves to give a three point contact with the conductor. As the distance between the outer sheared edges 415B is slightly larger than the distance between the inner sheared edges 415A, upon realignment of the sheared edges a three point contact is made with the conductor, as shown in FIG. 26C. It should be understood that in the third embodiment, both wire entries 412 and 418 in the terminal 210 are each the same size, and because of the axial displacement of the sheared edges 415A, 415B as shown in FIG. 26A, either of the wire entries 412 or 418 will allow the termination of either a large or a small conductor. This would allow the terminal to splice a second line thereto, for example, if the terminal is used as a telephone interconnect, as two wires can be terminated in the wire terminating slots, a "party line" could be created by simply terminating a second wire to the terminal.

The second and third embodiments shown in FIGS. 23 through 27 would also be arranged in an array similar to the one shown in FIG. 1. The mounting blocks 300, 500 would be similar to the mounting block 100 as shown in FIG. 19 with a lower access to the lower insulation displacement portions 206, 406. A multiconductor cable would be terminated to the individual terminals 210 in a similar manner to the termination shown in FIG. 20 and sealed in a manner similar to that shown in FIG. 21.

Thus, the subject invention relates to a cylindrical terminal and terminating cap for terminating either large or small wires as an interconnection for such signal carrying applications as telephone service. The terminal cap has a single wire receiving hole for receiving either a large or small wire, and the terminal is designed to terminate either large or small wire for electrical termination. If a large wire is presently utilized by a phone service, and the wire is to be replaced by a small wire, the large wire is removed from the terminal and the small wire can then be terminated to the respective small wire receiving slot.

Although the preferred embodiment is disclosed, it is conceivable that alternate embodiments are available. For example, angle of rotation required to terminate a wire could be changed by varying the included angles of the lug 64 on cap 50 and the included angle between surfaces 32A and 32B. The large and small wire openings, 12 and 20, respectively of terminal 10, could be slightly offset, rather than directly opposed. Other various embodiments which would be obvious to one skilled in the art, are meant to be includable in the following claims.

What is claimed is:

1. An insulation displacement type terminal for terminating a conductor of an insulated wire thereto, comprising:

a spiralled cylinder stamped from conductive material and having continuous first and second adjacent layers defining a tubular wall, said cylinder having a first wire receiving entry through the wall of the cylinder which is in communication with a first slot that partially extends circumferentially around the terminal, and a cap having an annular wall, the cap being slidably receivable over the cylinder and rotatable with respect thereto, having an opening adjacent to and alignable with the first said wire receiving entry, whereby, when the cap is placed over the terminal such that the cap opening is aligned with the first said wire entry, and the wire is placed through both the cap opening and the first said wire receiving entry, rotation of the cap relative to said terminal, terminates the conductor of said wire within the slot in the terminal.

2. The terminal of claim 1, wherein the spiralled cylinder further comprises a second wire receiving entry through the wall of the cylinder, which is in communication with a second slot that partially extends circumferentially around the terminal.

3. The terminal of claim 3 wherein the first and second layers are also spiralled axially such that the adjacent wire receiving slots in the first and second layers are axially offset.

4. The terminal of claim 2, wherein the second wire receiving entry is directly opposed from said first wire receiving entry.

5. The terminal of claim 2, wherein the first said wire receiving opening and first slot are larger than the second said wire receiving opening and second slot, whereby a larger guage wire may be terminated in the first said wire receiving opening and first slot, than in the second said wire receiving opening and second slot.

6. The terminal of claim 1, wherein the cap further comprises a cylindrical member concentrically disposed within said annular wall of said cap, the outer diameter of said cylindrical member and the inner diameter of said annular wall defining an annular channel.

7. The terminal of claim 6, wherein the opening in the cap extends through the cylindrical member in the cap defining an aperture connecting the first and second said wire receiving openings.

8. The terminal of claim 7, wherein the cap has channel means in alignment with and opposed to the opening in said cap, allowing the small wire to extend radially through the second said wire receiving opening and beyond the outer diameter of the tubular wall.

9. The terminal of claim 8, wherein the channel means comprises a channel extending longitudinally of said cap, said channel having side walls and an end wall, said end wall extending radially further than said annular wall of said cap.

10. An electrical connector of the insulation displacement type for terminating a conductor of an insulated wire thereto, comprising:

a spiralled cylindrical terminal stamped from conductive material and having continuous first and second adjacent layers defining a tubular wall, said terminal having a first wire receiving entry through the wall of the cylinder which is in communication with a first slot that partially extends circumferentially around the terminal; and a cap having an annular wall, the cap being slidably receivable over the cylinder and rotatable with respect thereto, the cap further comprising means to rotate said wire upon rotation of said cap, said rotation means being adjacent to and alignable with the first said wire receiving entry, whereby, when the cap is placed over the terminal such that the rotation means is aligned with the first said wire entry, and the wire is placed through the first said wire receiving entry and proximate to the rotation means, rotation of the cap relative to said terminal, terminates the conductor of said wire within the slot of the terminal.

11. The connector of claim 10 wherein the rotation means comprises a protrusion through the cap annular wall such that upon rotation of said cap, the wire is rotated by abutment against a side edge of said annular wall.

12. The connector of claim 11 wherein the protrusion comprises an opening through the annular wall adjacent to the first said wire entry whereby rotation of the cap causes the wire to abut an edge of said opening causing said wire to rotate into said slot.

13. The connector of claim 11 wherein the terminal further comprises an access hole diametrically opposed from the wire receiving entry and the protrusion includes a channel integral with said cap disposed longitudinally of said cap and disposed adjacent to the first said wire entry in the unterminated condition.

14. The connector of claim 13 wherein the channel has side edges and an end wall, said side edges and end wall profiled such that upon placing a wire through the access hole disposes the wire beyond the tubular wall and into the channel, and rotation of the cap causes a side edge of the channel to force the wire into the first said wire receiving slot.

15. The connector of claim 10 wherein the terminal comprises a second wire receiving opening in communication with a second wire terminating slot.

16. The connector of claim 15 wherein the first and second wire receiving openings are disposed in opposite sides of the terminal wall in diametrically opposed relationship.

17. The connector of claim 16 wherein the first wire receiving opening is profiled for receiving a large gauge wire and the second wire receiving opening is profiled for receiving a small gauge wire, the cap comprising an opening through the cap in alignment with the diametrically opposed first and second wire receiving openings.

18. The connector of claim 17 wherein the cap comprises a longitudinally extending channel disposed adjacent to the second wire receiving opening, the channel having side edges and an end wall, said side edges and end wall profiled such that placing a small wire through the first wire receiving opening disposes the small wire beyond the tubulat wall of the terminal and into the channel, and rotation of the cap causes a side edge of the channel to force the small wire into the second wire receiving slot.

19. The connector of claim 17 wherein the cap is profiled to receive either a small or a large wire through the same opening, the cap including stop means profiled such that upon placing a large wire through the opening in the cap, the large wire is disposed within the large wire receiving opening but is precluded from entering the small wire receiving opening, and upon placing a small wire through the opening in the cap, the small wire extends through the large wire receiving opening past the stop means and through the small wire receiving opening.

20. An electrical connector of the insulation displacement type, comprising:

a plurality of cylindrical terminals having a large wire receiving entry therein extending through a wall of the terminal in communication with a large wire receiving slot which partially extends circumferentially around the terminal, and further comprising a small wire receiving entry through a wall of the terminal in communication with a small wire receiving slot which partially extends circumferentially around the terminal;

a cap member disposed over the terminal;

opening means comprising a communication with the large and small wire receiving entries, said opening means being profiled to allow the large wire to enter the large wire receiving entry to be terminated within the large wire receiving slot but preventing the large wire from entry into the small wire receiving entry; whereby placement of the large wire through the opening means disposes the large wire within the large wire entry and rotation of the cap terminates the large wire within the large wire receiving slot, and placement of the small wire through the opening means disposes the small wire within the small wire receiving entry and rotation of the cap terminates the small wire within the small wire receiving slot.

21. The connector of claim 20 further comprising an insulative base member having a plurality of tubular extensions upstanding from said base, said tubular extensions having cylindrical openings therein for receiving the terminals therein.

22. The connector of claim 21 wherein the large and small wire entries are vertically disposed in the same side of the terminal wall, one above the other.

23. The connector of claim 22 wherein the large and small wire receiving slots extend in the same direction from the respective small and large wire receiving entries to vertically dispose the slots one above the other.

24. The connector of claim 22 wherein the terminal is received within the tubular extensions to dispose the wire receiving openings below an end of said tubular extension and the cap has an annular wall which is profiled to be slidably received over the terminal but inside of the tubular extension, the opening means comprising a cooperation between the tubular extension, the terminal and the cap.

25. The connector of claim 24 wherein the wire receiving openings are radially disposed from said opening means.

26. The connector of claim 25 wherein the opening means comprises a keyhole slot in said tubular extension including a large hole in transition with a narrower slot, the keyhole slot generally extending along the longitudinal length of the tubular extension, the opening means further comprising a large slot and a small slot in said cap, each extending circumferentially around said cap, the opening means further comprising a large and small hole in said terminal, the large hole in the keyhole slot being in alignment with the large slot in said cap and with the large hole in said terminal, and the narrow slot of the keyhole slot being in alignment with the narrow slot within the cap and with the small hole within the terminal, whereby when a large wire is placed through the large hole of the keyhole slot the wire extends through the large slot of the cap and through the large hole in the terminal and through the terminal to be disposed in the large wire receiving entry, and when a small wire is placed in the narrow slot of the keyhole slot, the small wire extends through the narrow slot of the cap and through the small hole in the terminal and through the terminal to be disposed in the small wire receiving entry.

27. The connector of claim 26 wherein the cap further comprises a channel member extending longitudinally of the cap disposed adjacent to the wire receiving entries such that upon placement of a wire into one of the respective wire receiving openings the wire can extend beyond the terminal cylindrical wall and into the channel, and the tubular extension comprising a radial cutout portion partially extending along the longitudinal length of the tubular extension to form two upstanding edges, the cap disposed within said tubular extension such that the channel is placed between the edges of said extension, the angle of rotation of the cap being defined by the interference between the channel and the edges of the tubular extensions.

28. An electrical connector of the insulation displacement type, comprising:

a terminal means comprising a tubular body of double thickness material around at least a portion of its circumference and comprising an inner and outer layer, the terminal means comprising a first wire admitting opening means in transition with a wire receiving slot means, the wire opening means comprising overlying openings through the first and second layers, and the wire receiving means comprising a first slot in the outer layer and a second slot in the inner layer, the first and second slots being radially aligned and axially offset from each other;

a cap having an annular wall, the cap being slidably receivable over the cylinder and rotatable with respect thereto, the cap further comprising means to rotate said wire upon rotation of said cap, said rotation means being adjacent to and alignable with the first said wire receiving entry.

29. The electrical connector of claim 28 wherein the first and second slots are offset to the extent that the wire receiving slots can accomodate more than one wire size.

30. The connector of claim 29 wherein the wire receiving slots are defined by two sheared edges and the distance between the two closest inside and outside edges is less than the diameter of the wire to be terminated.

* * * * *